United States Patent [19]
Simoneau
[11] 4,318,231
[45] Mar. 9, 1982

[54] ICE STUD FOR SHOES

[76] Inventor: Conrad Simoneau, 760 Farm Rd., Marlboro, Mass. 01752

[21] Appl. No.: 121,903

[22] Filed: Feb. 15, 1980

[51] Int. Cl.³ ..... A43C 15/00
[52] U.S. Cl. ..... 36/67 R; 36/134
[58] Field of Search ..... 36/67 R, 67 A, 67 B, 36/67 C, 67 D, 59 R

[56] References Cited

U.S. PATENT DOCUMENTS

| | | | |
|---|---|---|---|
| 1,948,885 | 2/1934 | Riddell | 36/67 D |
| 2,911,738 | 11/1959 | Clerke | 36/67 D |
| 3,331,148 | 7/1967 | Hollister et al. | 36/67 A |
| 3,566,489 | 3/1971 | Morley | 36/67 D |

*Primary Examiner*—Patrick D. Lawson
*Attorney, Agent, or Firm*—Robert R. Churchill

[57] ABSTRACT

In a jogging shoe having a rubber sole, and a mid-sole detachably secured in the soles, a stud for enabling the runner to run safely in winter under icy conditions. The stud projecting from the out-sole of the shoe.

1 Claim, 3 Drawing Figures

ICE STUD FOR SHOES

BACKGROUND OF THE INVENTION

The present invention relates to shoes having rubber or composition soles having studs embedded in the soles with a portion thereof projecting from the sole and to jogging shoes in particular. The present shoes embodying the novel stud are particularly suited for winter running and are highly efficient in providing secure footage and preventing slipping.

All of the pertinent prior art of which I am aware is listed as follows, none believed to be anticipatory of the present invention.

DESCRIPTION OF THE PRIOR ART

In all of the prior art patents of which I am aware the studs or spikes are permanently bonded into the sole of the shoes by molding them into position during the formation of the shoes or the soles therefor. In addition to the molded type of construction some shoes having retaining members bonded during the molding operation into the sole such that the stud or spike is screwed or pressed into the retaining elements to be secured in position.

Each of these types of spikes and/or the shoe constructed is complex and quite expensive compared to those of the present invention.

The following is a list of the prior art of which I am aware:

The U.S. Pat. Nos. found are as follows: 4,083,126, 3,600,831, 3,566,489, 3,522,669, 3,553,858, 2,652,638, 1,022,106.

FIELD OF THE INVENTION

The present invention has for a principal object to provide a novel and improved stud for shoes, and jogging shoes in particular whereby a runner is given additional traction during running in snow and ice whereby serious injuries due to slipping are substantially prevented or reduced.

Another object of the invention is to provide in combination, a jogging shoe which may be easily adapted for winter running by the insertion into the sole thereof replaceable studs for gripping the snow and ice.

A still further object of the invention is to provide a stud for shoes having a novel and improved construction whereby it may be readily embedded in or removed from the soles of jogging shoes previously manufactured and which may be readily and economically manufactured.

Another object of the invention is the construction of the stud which not only facilitates its insertion into the sole of a pre-manufactured shoe, but enables the stud to remain in the shoe even after rigorous use of the shoe for winter running.

With general objects in view other objects and advantages of the present invention will be apparent from the following description of the invention and the claims which follow together with the drawing attached hereto and made a part of the application.

DRAWINGS

In the drawing illustrating the present invention:

SUMMARY OF THE INVENTION

Figure 1:
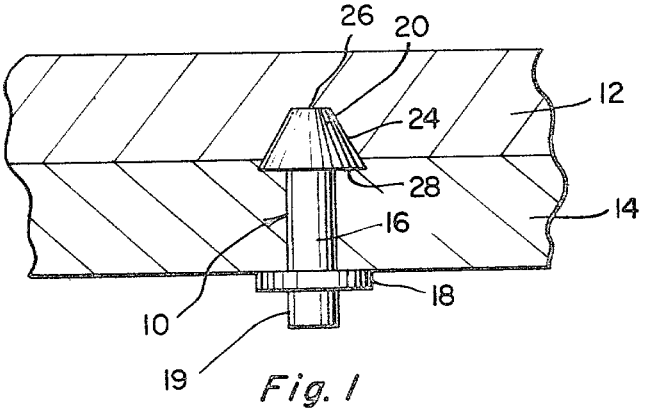
FIG. 1 is a partial section of a shoe showing the present stud in place in the shoe soles.
Figure 2:
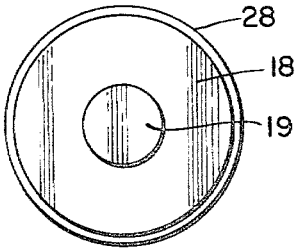
FIG. 2 is a top view of the stud.
Figure 3:
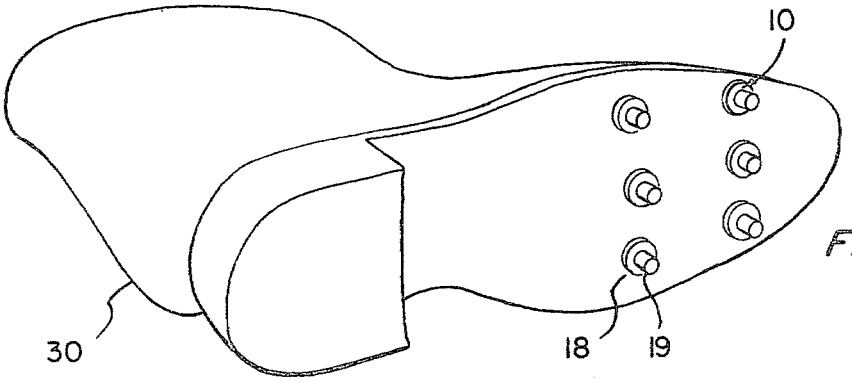
FIG. 3 is a perspective view of a jogging shoe illustrating the stud in operative position in the sole of the shoe.

Referring now to the drawing illustrating the preferred embodiment of the invention 10 represents the present novel stud embedded within the mid-sole 12 and out-sole 14 of the shoe partially shown.

The stud fabricated from heat treatable steel such as "tool" steel which may be purchased on the market comprises a tubular shank portion 16, which in the preferred form of the invention is from $\frac{1}{4}''$ to $\frac{3}{8}''$ in length, a laterally extended flange portion 18, preferably $\frac{3}{8}''$ in diameter and a tip or spike 19 $\frac{1}{8}''$ in diameter extending to from $\frac{1}{8}''$ to $\frac{1}{4}''$ beyond the flange 18. At the opposite end of the shank portion 16 an integral fusto-conically shaped head 20 is provided. The tapered sides 22, 24 and narrow flat surface 26 of the head 20 not only make insertion of the stud into the sole relatively easy, but also help to retain the stud in operative position within the soles. In the preferred embodiment of the invention the head 20 is 3/16" to $\frac{1}{4}''$ wide at its base and $\frac{1}{8}''$ in length. The base of head 20 forms with the shank portion 16 as annular flange 28 which prevents accidental removal of the stud from the shoe during its use as will hereinafter to be more fully described.

While in the foregoing description the present stud has been described as comprising heat treatable tool steel, such a tool steel it will be understood that other comparable steels may be used as well as tough rigid plastic materials all within the scope of the present invention.

In operation the present stud is particularly adapted to be inserted in the soles of previously manufactured shoes, and jogging shoes in particular. This enables a jogger to adapt his shoes to winter use easily by merely inserting the novel studs into the soles of his present shoes. When the studs become worn they can be readily replaced with new ones thus eliminating the need for the purchase of new shoes or the need for winter and summer shoes.

In order to insert the studs a sharp tool such as an ice pick or the like (not shown) is used to punch relatively small holes into the soles, i.e. mid and outer soles of the shoe 30. The studs head, end first, are then inserted into the pre-punched holes. Since the sole composition is rubber or like material of a similar composition having what is commonly known as "memory" it is compressed as the hole is punched and the stud inserted and relaxes or expands after the insertion so that it grips the shank portion 16 firmly as it fills in under the annular flange 28 and above the laterally extended flange 18. Thus it will be seen that annular flange 28 resists withdrawal of the stud and laterally extended flange 18 limits the distance of insertion.

From the foregoing description of the present invention it will be apparent that the present novel and improved stud for shoes and jogging shoes in particular provides a highly efficient, economical constructure which enables ready made shoes to be easily converted into safe winter shoes. It has been established that the present stud not only provides for safe winter running, but also helps to slow down wear on the outside of the heel of the shoe. A factor common in the use of jogging shoes.

While the present stud has been heretofore illustrated and described as being embodied in jogging shoes it may be embodied in other shoes or boots wherein traction on ice or snow is a necessary factor.

Having thus described the invention, what is claimed is:

1. In combination, a shoe having a resilient out-sole and mid-sole and a removeable one piece stud embedded in said soles in which a portion of the stud projects beyond the outer surface of the sole, said stud comprising: a shank portion having a fusto-conical head at one end thereof, a tubular spike at its other end and an integral annular flange spaced upwardly a short distance from the tip end of the spike, said stud being embedded in the soles of the shoe with the fusto-conical head disposed in the mid-sole with its base resting on the inner surface of the out-sole and the shank in the out-sole with the annular flange bearing on the out-sole outer surface so that the spike projects beyond the outer surface of the out-sole and further insertion of the stud into the shoe is prevented.

* * * * *